US005830092A

United States Patent [19]

Meeks

[11] Patent Number: 5,830,092

[45] Date of Patent: Nov. 3, 1998

[54] TENNIS BALL FABRIC

[75] Inventor: Randy Gregg Meeks, LaGrange, Ga.

[73] Assignee: Milliken Research Corporation, Spartanburg, S.C.

[21] Appl. No.: 988,828

[22] Filed: Dec. 11, 1997

[51] Int. Cl.[6] ..... A63B 39/00

[52] U.S. Cl. ..... 473/606; 442/321; 442/381

[58] Field of Search ..... 473/569, 574, 473/573, 596, 604, 605, 606; 442/35, 36, 320, 34, 323, 327, 358, 381, 382, 383, 387, 388, 389, 391, 392, 482

[56] References Cited

U.S. PATENT DOCUMENTS

| | | | |
|---|---|---|---|
| 127,813 | 6/1872 | Waite | 442/321 |
| 1,737,607 | 12/1929 | McDermott | 442/321 |
| 2,706,514 | 4/1955 | Anderson | 473/606 |
| 2,777,787 | 1/1957 | Bragg, Jr. | 442/323 |
| 4,222,806 | 9/1980 | Parker | 473/606 |
| 4,439,471 | 3/1984 | Lacoste et al. | 473/606 |

*Primary Examiner*—Steven Wong

*Attorney, Agent, or Firm*—Terry T. Moyer; Earle R. Marden

[57] ABSTRACT

A tennis ball having an outer felt fabric comprising at least two layers of non-woven fabric with the outer layer having a weight ratio of wool therein greater than 45% and the inner or bottom layer having a weight ratio of wool therein less than 40%.

12 Claims, 1 Drawing Sheet

TENNIS BALL FABRIC

This invention relates generally to tennis ball covering felt, and more particularly to a method and means for manufacturing tennis ball covering felt.

A tennis ball consists generally of a spherical rubber core covered with a cloth having a felted surface. The surface of the felt offers wind resistance in flight, and frictional contact with a tennis racket in the hands of a contestant, so that the path of the ball can be controlled. Without this control the game cannot be played satisfactorily.

The fabric felt is very important not only to the play performance of the tennis ball, but also to the cosmetic quality of the finished ball. If the fabric is properly engineered, it can meet all the needs of the ball manufacturer which is a specific play characteristic for each level of player and court surface as well as a ball relatively free from cosmetic defects such as seam cracks, ghosting of edge adhesive, puckers, lumps, overlaps, irregular seams, and visible 3rd cure rings after fluffing. The traditional proven method of making tennis felt cover has been with yarn and woven technology subsequently napped and finished. An alternative technology has been needlepunch technology whereby fiber is oriented in layers from a non-woven card and subsequently needled to entangle the fibers with or without a scrim for support. This fabric may or may not then be finished to try to make it more soft and conducive to covering a spherical core.

My invention consists of the preparation of a needlepunched fabric which has the necessary characteristics so that it will be firm enough to give the cover stability during the manufacture of the ball, with a smooth inside surface to allow good adhesion to the rubber core of the ball, and to be of such quality that it will accept the application or formation of a proper playing surface applied to it.

It is therefore an object of the invention to provide a tennis ball with a needlepunched felt fabric which provides good adhesion to the core and long-lasting playing quality and will be described with reference to the accompanying drawing in which.

The art of manufacturing tennis balls has been well developed heretofore by such companies as Dunlop Rubber Company Ltd. of London, England and Wilson Sporting Goods of Chicago, Ill. The manufacture of fabric covers for tennis balls generally include the stamping of "dumbbell" shapes and a pair of these shapes being applied to a vulcanized core. Prior to stamping the dumbbells, the fabric and cores are coated with a compatible adhesive and presented to a 3rd curing operation after a stack of dumbbells have been dipped with an edge adhesive and individually applied to the core. After this heat curing step, you have a ball with wide seams separating the pair of dumbbells, but are left with a circular ring from the point at which the two halves of the press come together and trap fiber. This is known in the industry as a "3rd cure ring" and must subsequently be removed by a process where live steam is presented to the balls for an extended period of time.

The problem with the needlepunch technology has been that it produces a stiffer more rigid material that does not meet all of the above stated requirements of the ball manufacturers. Prior to this invention, production levels dropped off in many cases as much as 50% in order to produce a finished tennis ball that even approached the cosmetic quality level of balls produced from the traditional method.

Prior to the introduction of this invention, the commercial success of needlefelt was limited to practice balls or casual players who are not as particular as to the appearance of the finished balls and require minimum performance characteristics.

Figure 1:
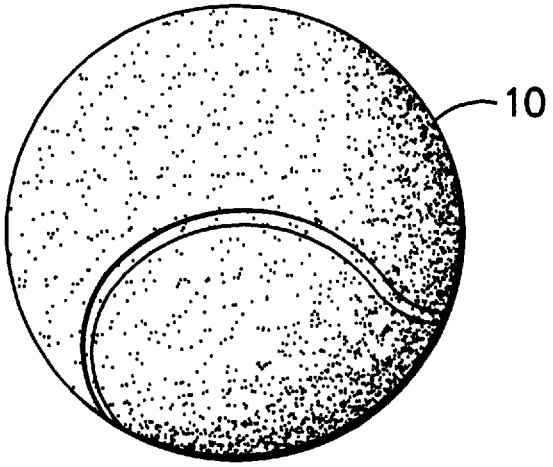
FIG. 1 is a typical felt covered tennis ball.
Figure 2:
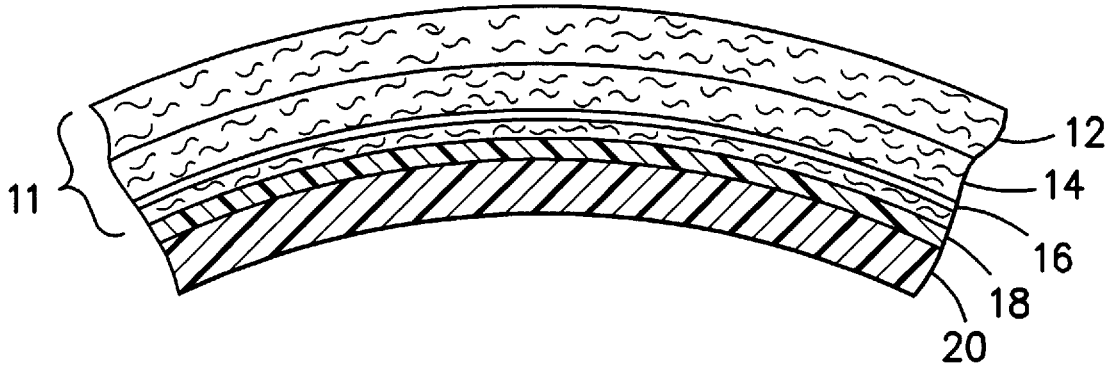
FIG. 2 is a cross-section view through one side of the ball shown in FIG. 1.

Looking now to the drawings, the reference numeral 10 in FIG. 1 refers to a tennis ball having a needlepunched felt 11 serving as an outer layer as shown in FIG. 2 which is adhesively secured by an adhesive 18 to the inner rubber layer 20 of the ball 10. The adhesive 18 preferably is a solvent based natural rubber adhesive but other suitable adhesives such as a water based latex could be used, if desired.

The outer felt 11 basically consists of two non-woven layers 12 and 14 with the bottom non-woven layer 14 being initially formed and needlepunched through a scrim fabric 16, preferably a weft inserted knitted scrim, and the outer non-woven layer 12 is needled punched to the bottom layer 14 after the inner layer has been needlepunched through the scrim fabric 16.

By manufacturing the tennis felt 11 in layers independently, the wool content (defined as the weight ratio of wool fibers to other fibers in that given layer) can be altered to create a differential between the top layer and the bottom layer. By keeping the top layer greater than 45% by weight as compared to the other fiber in this layers blend, you can obtain the required "fluff level" and have enough wool content to overcome the 3rd cure ring in the steaming operation. The remaining fibers can be any manmade or natural fibers but the preferred fibers in this claim are nylon for its abrasion resistance as this surface pad must absorb all the rigors of racquet impact and court surface contact.

The bottom layer of this invention can be constructed with any technology as described above to create a differential in the wool content between this layer and the top layer. By keeping this layer at 40% wool or less, the impact to the finished product is such that fewer fibers are available to "lock" to surrounding fibers when exposed to mechanical action. The resulting fabric is one of a softer nature with stretch characteristics more conducive to the covering of a spherical shape. The remaining fibers in the bottom blend can be any manmade or natural fibers but the preferred fibers in this claim are acrylic and nylon. Extensive analysis has confirmed the correlation of improved processability and cosmetic reject reduction to an increase in the differential of wool between the top layer and the bottom layer.

While the preferred invention is of only two layers, the same invention is made for multiple layers where differential amounts of wool could be positioned to reach the same objective. In the case of this invention, the layers are needled into a weft insertion knitted scrim designed for optimum stretch characteristics. This claim is intended to apply to all types of scrims as well as a construction whereby the scrim is not used at all. The claim in all cases is that the differential in wool content is responsible for the success of the product.

The end use of the product depends on the player and court surface and the product designed has implications as to the ratio of the layers. It has been found that products that have less stringent requirements need only approximately a 20% ratio of top layer to bottom layer (weight of top layer÷total weight of both layers excluding scrim weight). Products that have greater requirements may need to have as much as 80% top layer ratio to the bottom layer using the same mathematical formula. This invention is to cover construction of the full range of products needed by the market as long as the wool differential exist between the layers.

The above described embodiments are given for the purpose of illustration only and improvements and modifications may be made without departing from the scope or spirit of the invention.

I claim:

1. A tennis ball felt fabric comprising: a first non-woven needlepunched fabric having 40% or less by weight of wool fibers and a second non-woven fabric needlepunched to said first fabric having a wool fiber content by weight greater than 45%.

2. The felt fabric of claim 1 wherein said first fabric has a scrim fabric on one side thereof.

3. The felt fabric of claim 2 wherein said scrim fabric is weft inserted warp knit fabric.

4. The felt fabric of claim 1 wherein the ratio between the weight of the first and second layers is in the range of 20–80%.

5. The felt fabric of claim 4 wherein said first fabric has a scrim fabric on one side thereof.

6. The felt fabric of claim 5 wherein said scrim fabric is weft inserted warp knit fabric.

7. A tennis ball comprising a needlepunched felt outer fabric adhesively secured to a rubber core, said needlepunched felt outer fabric comprising: a first non-woven needlepunched fabric having 40% or less by weight of wool fibers and a second non-woven fabric needlepunched to said first fabric having a wool fiber content by weight greater than 45%.

8. The felt fabric of claim 7 wherein said first fabric has a scrim fabric on one side thereof.

9. The felt fabric of claim 8 wherein said scrim fabric is weft inserted warp knit fabric.

10. The felt fabric of claim 7 wherein the ratio between the weight of the first and second layers is in the range of 20–80%.

11. The felt fabric of claim 10 wherein said first fabric has a scrim fabric on one side thereof.

12. The felt fabric of claim 11 wherein said scrim fabric is weft inserted warp knit fabric.

* * * * *